US006441264B1

(12) United States Patent
Lemaire et al.

(10) Patent No.: US 6,441,264 B1
(45) Date of Patent: Aug. 27, 2002

(54) METHOD FOR SEPARATING BENZOTHIOPHENE COMPOUNDS FROM HYDROCARBON MIXTURE CONTAINING THEM, AND HYDROCARBON MIXTURE OBTAINED BY SAID METHOD

(75) Inventors: Marc Lemaire, Villeurbanne; Michéle Monnet; Michel Vrinat, both of Caluire; Valérie Lamure, Lyons; Emmanuelle Sanson, Sainte-Foy-les-Lyon; Alexandra Milenkovic, Collonges aux Monts d'or, all of (FR)

(73) Assignee: Total Raffinage Distribution S.A. (FR)

( * ) Notice: Subject to any disclaimer, the term of this patent is extended or adjusted under 35 U.S.C. 154(b) by 0 days.

(21) Appl. No.: 09/445,369

(22) PCT Filed: Jun. 11, 1998

(86) PCT No.: PCT/FR98/01218

§ 371 (c)(1),
(2), (4) Date: Apr. 17, 2000

(87) PCT Pub. No.: WO98/56875

PCT Pub. Date: Dec. 17, 1998

(30) Foreign Application Priority Data

Jun. 12, 1997 (FR) ..... 97 07538

(51) Int. Cl.[7] ..... C10G 29/22; C10G 17/02; C07C 5/333; C07C 7/10; C07C 7/17

(52) U.S. Cl. ..... 585/833; 585/860; 585/857; 585/863; 585/658; 585/662; 585/663; 585/660; 208/240; 208/242; 208/236

(58) Field of Search ..... 585/833, 860, 585/857, 863, 658, 662, 663, 660; 208/240, 242, 236

(56) References Cited

U.S. PATENT DOCUMENTS

| | | | | |
|---|---|---|---|---|
| 4,171,260 A | | 10/1979 | Fracasiu et al. | 208/240 |
| 5,130,285 A | * | 7/1992 | Wang et al. | 502/309 |
| 5,454,933 A | | 10/1995 | Savage et al. | 208/212 |

FOREIGN PATENT DOCUMENTS

| | | | |
|---|---|---|---|
| EP | 0 670 361 A1 | | 9/1995 |
| EP | 0 739 972 A2 | | 10/1996 |
| EP | 991736 A1 | * | 4/2000 |

* cited by examiner

*Primary Examiner*—Walter D. Griffin
*Assistant Examiner*—Tam M. Nguyen
(74) *Attorney, Agent, or Firm*—Cantor Colburn LLP

(57) ABSTRACT

A method for separating at least a benzothiophene compound from a hydrocarbon mixture is disclosed. The method includes contacting the mixture of a fraction obtained therefrom with a reagent including an acceptor complexing agent π, to obtain a donor-acceptor complex between the acceptor complexing agent and the benzothiophene compound; and separating the complex from the mixture, or from the fraction, to obtain a fraction depleted or purified in the benzothiophene compound.

21 Claims, 5 Drawing Sheets

METHOD FOR SEPARATING BENZOTHIOPHENE COMPOUNDS FROM HYDROCARBON MIXTURE CONTAINING THEM, AND HYDROCARBON MIXTURE OBTAINED BY SAID METHOD

The present invention relates to the separation of benzothiophene compounds from a mixture of hydrocarbons comprising them, for example from a fuel, such as gas oil. The importance of such a separation has increased in recent years as a result of the introduction or the envisaged application of various laws across the whole world targeted at lowering the level of sulfur-comprising products in gas oil.

In the description which follows and in the claims, the expressions given hereinbelow have the following respective meanings:

"benzothiophene compounds" means both benzothiophene and its homologues, for example dibenzothiophene, and the mono-, di- or trisubstituted derivatives of these, for example dialkyl, trialkyl, alkenyl and aryl;

"electron-withdrawing" means any organic compound which is deficient or impoverished in electrons and in particular substituted by groups which are themselves electron-withdrawing groups, for example the sulfo, nitro, halo, haloalkyl, for example trifluoromethyl, cyano, carbonyl, carboxyl, amido or carbamido groups or a combination of these;

"gas oil" means, for example, a diesel engine fuel, a kerosene, a heating oil and other fuel oils exhibiting a boiling temperature generally of between approximately 175° C. to [sic] approximately 400° C.

Among the molecules present in such mixtures of hydrocarbons, for example in gas oil, benzothiophene compounds, in particular dialkyldibenzothiophenes, for example 4,6-dimethyldibenzothiophene (DMDBT), are known as being among the most resistant to the usual catalytic processes for deep hydrodesulfurization. For this reason, the present invention will be more particularly described and explained with respect to the separation of this molecule.

The conventional hydrodesulfurization process mentioned above, which is well known per se, requires fairly drastic and expensive operating conditions to remove or only reduce the content of dibenzothiophene derivatives in mixtures of hydrocarbons, for example gas oils, which limits its industrial application. There has consequently been a search to find a process which makes it possible to separate this group of molecules selectively and efficiently from the other constituents of such mixtures.

U.S. Pat. No. 5,454,933 discloses an approach for reducing the content or selective separation of dibenzothiophene (DBT) or its derivatives in a gas oil feed by adsorption of the dibenzothiophene molecules on solid supports, such as activated carbon, zeolites, silica/alumina, and the like. The selection carried out is based essentially on the shape of the molecule to be removed, that is to say that only steric factors come into consideration in the application of this process. This method has proved to be efficient but its practical and economic advantage is limited by two characteristics of the materials used as adsorbents. On the one hand, their adsorption capacity for dibenzothiophene does not exceed 12% by weight and, on the other hand, their selectivity with regard to aromatic compounds, such as 1-methylnaphthalene (MN), measured by the separation factor $\alpha_{DBT/MN}=[DBT/MN]_{ads}/[DBT/MN]_{soln}$) [sic], is only 7 in the best of the cases cited.

The present invention has been set the problem of at least partially, indeed even completely, in an inexpensive way, separating the benzothiophene compounds as defined above from a mixture of hydrocarbons comprising them, for example gas oil, by the application of another treatment route which is independent of the only steric factors touched on above in the above United States patent.

This problem has been solved, surprisingly, by the application not of a principle of shape selectivity as described in the abovementioned patent but by the application of the principle of interaction of donor-acceptor type (or of charge transfer type) in carrying out the separation of the benzothiophene compounds.

A subject matter of the present invention is consequently a process for the separation of at least one benzothiophene compound from a mixture of hydrocarbons comprising it, the process being more particularly characterized in that said mixture or a fraction obtained from the latter is brought into contact with a reagent comprising a π-acceptor complexing agent, in order to obtain a donor-acceptor complex between the acceptor complexing agent and said benzothiophene compound, and in that said complex is separated from said mixture or from said fraction, in order to obtain a fraction impoverished in or purified from said benzothiophene compound.

The application of the principle given above makes possible a very selective separation (α greater than 100) with respect to non-sulfur-comprising aromatic compounds and a much more efficient separation (capacity, for example, of the order of 30% to 50%) than according to the process disclosed in the abovementioned United States patent.

A process according to the present invention makes it possible to obtain a desulfurized mixture of hydrocarbons exhibiting a sulfur content of between 0 ppm and 2000 ppm, preferably between 0 ppm and 500 ppm.

A process according to the present invention makes it possible to decrease the load of benzothiophene compounds to a value of between 0% and 75% and preferably between 0% and 15%, with respect to the initial weight of said compounds.

In a preferred form of the invention, the process is carried out in a homogeneous phase, that is to say without the intervention of a solid phase for attaching or supporting the π-acceptor complexing agent.

In another preferred form of the invention, the process is carried out in a heterogeneous phase, that is to say with the intervention of a solid phase as defined above.

The process for the separation of benzothiophene compounds can also be carried out before or after the stage of deep catalytic hydrodesulfurization known per se. Advantageously, and in order to render the separation process more advantageous from an economic view point, the latter is carried out before a stage of deep catalytic hydrodesulfurization, in which case the fraction impoverished in benzothiophene compound is subjected to a deep catalytic hydrodesulfurization. This is because the process according to the invention makes it possible in particular to remove the dibenzothiophene compounds and thus makes it possible to carry out the stage of deep catalytic hydrodesulfurization under milder temperature and pressure conditions and thus to prolong the lifetime of the catalyst.

The complex is preferably separated from the mixture by extraction with an organic solvent, for example chloroform.

Furthermore, it is preferable to regenerate the reagent by separating the complex into benzothiophene compounds and complexing agent. The separation of the complex is preferably carried out chemically but can also be carried out by application of physicochemical means.

The reagent can be regenerated:

by reducing the complex separated from the mixture, in order to form a salt of the π-acceptor agent;

and by reoxidizing the salt, in order to regenerate the π-acceptor complexing agent.

In accordance with the present invention, the π-acceptor complexing agent comprises an electron-withdrawing compound or a compound which is impoverished in electrons. This agent is said to be a "π-acceptor" agent because, generally, it possesses a system of π electrons or of π type. The π-acceptor complexing agent preferably comprises an aromatic compound substituted by at least one electron-withdrawing group chosen more preferably from the group consisting of the sulfo, nitro, fluoro, trifluoromethyl, cyano, carbonyl, carboxyl, amido and carbamido groups. A preferred example of such a π-acceptor complexing agent is chosen from a group consisting of the family of substituted or unsubstituted quinones, more preferably dichlorodicyanobenzoquinone, anthraquinone, benzoquinone or tetracyanoquinodimethane, or the family of substituted or unsubstituted fluorenones, more preferably tetranitrofluorenone or dinitrofluorenone. Among these compounds, tetranitrofluorenone and tetracyanodiquinodimethane [sic] are even more preferred in constituting the π-acceptor complexing agent because of their increased separation factors and capacities.

According to a preferred embodiment of the invention, the reagent comprises a support, to which the π-acceptor complexing agent is attached, which is in the divided or undivided form and which is chosen from the group consisting of inorganic oxides, such as alumina and silica, activated charcoal, ion-exchange resins and zeolites. "In the divided form" means that the support can be in particular in the form of beads, for example glass beads, or of granules. The π-acceptor complexing agent can be supported and on the reagent [sic] by any appropriate means, for example by adsorption, absorption or covalent bonding.

According to another preferred embodiment of the invention, the reagent is composed essentially of the π-acceptor complexing agent and, in this case, it is more preferably a polymer of the latter. Polymer means both homopolymers formed solely from monomers of the π-acceptor complexing agent and copolymers of the latter with other polymers [sic].

Depending on the desired degree of separation of the benzothiophene compounds, the mixture or fraction of hydrocarbons to be treated and the applicational flow rate of the mixture or fraction, the time during which the mixture of hydrocarbons is in contact with the complexing agent can vary quite widely. Advantageously, the period during which the contacting operation is carried out can be between approximately 10 minutes and 150 hours and preferably between 2.5 hours to [sic] 115 hours.

The mixture of hydrocarbons comprising the benzothiophene compounds can be brought into contact with the reagent continuously, systematically or nonsystematically, for example in a column.

In such cases, the applicational flow rate of the mixture or of the fraction comprising the benzothiophene compounds to be separated can be between 0.5 ml/min to [sic] 50 ml/min per $cm^3$ of column volume and preferably between 0.5 ml/min to [sic] 10 ml/min per $cm^3$ of column volume.

Furthermore, the temperature at which the contacting operation is carried out can be between 10° C. and 60° C. and preferably between 15° C. and 30° C.

The separation process according to the present invention can be carried out batchwise, semi-continuously or continuously. However, in particular for reasons of economy, it is preferably carried out continuously.

The mixture of hydrocarbons is advantageously brought into contact with the reagent with stirring.

The mixture of hydrocarbons is preferably a gas oil, as defined above, and more preferably a diesel engine fuel.

The present invention will be better explained by the following examples, which serve solely to illustrate the invention, and by reference to the figures, in which.

Figure 4:
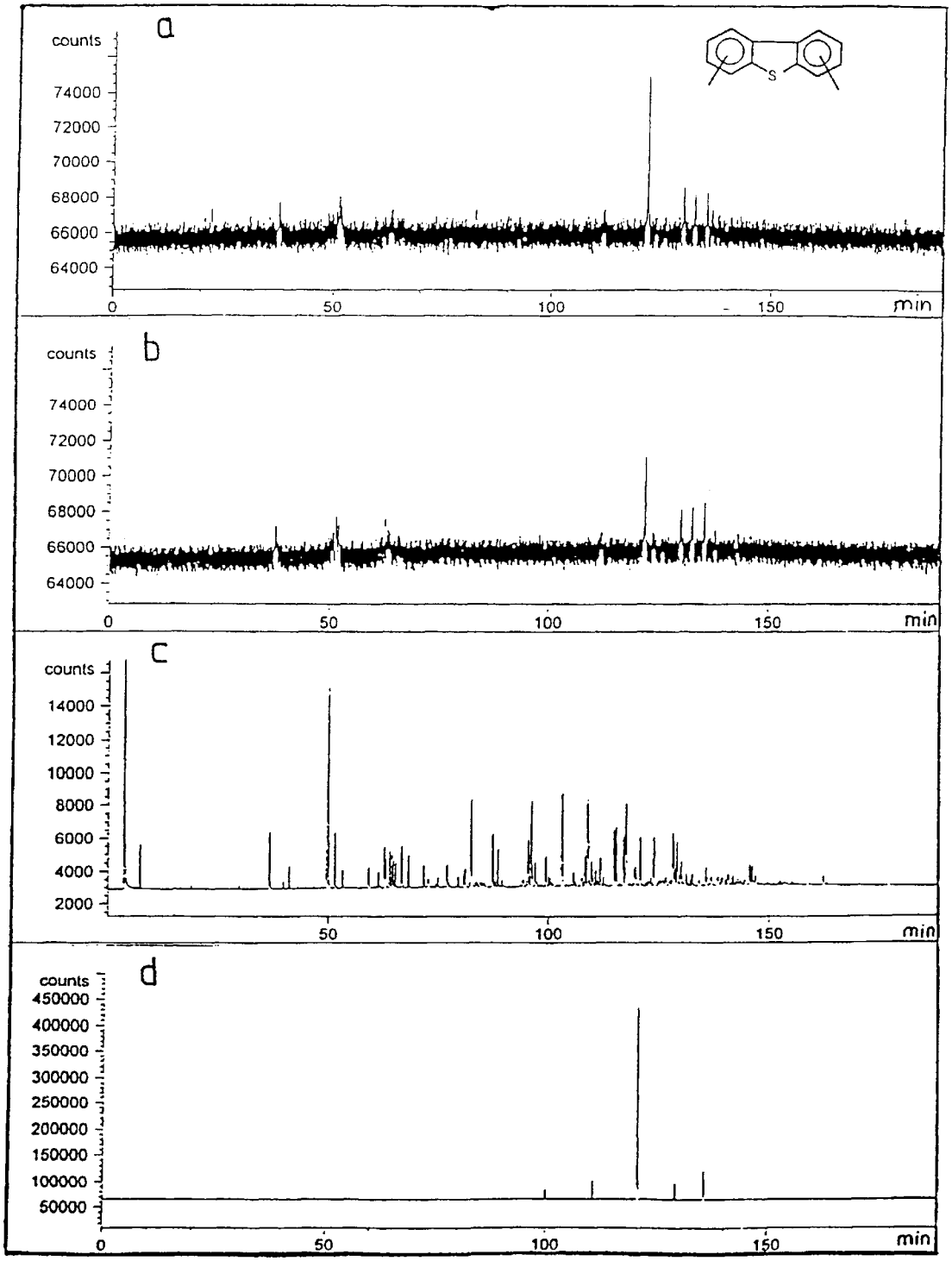
Figure 5:
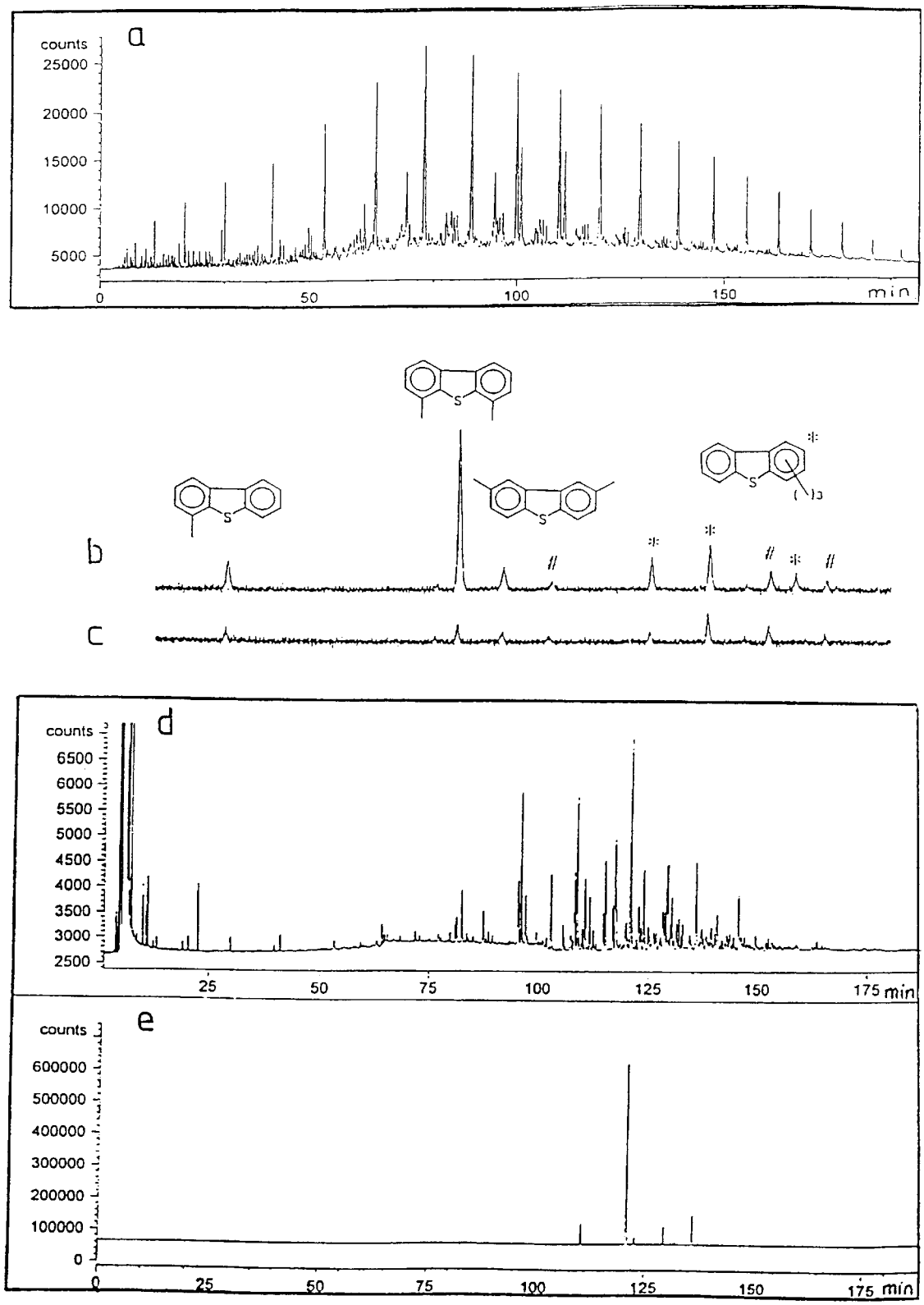
Figure 6:
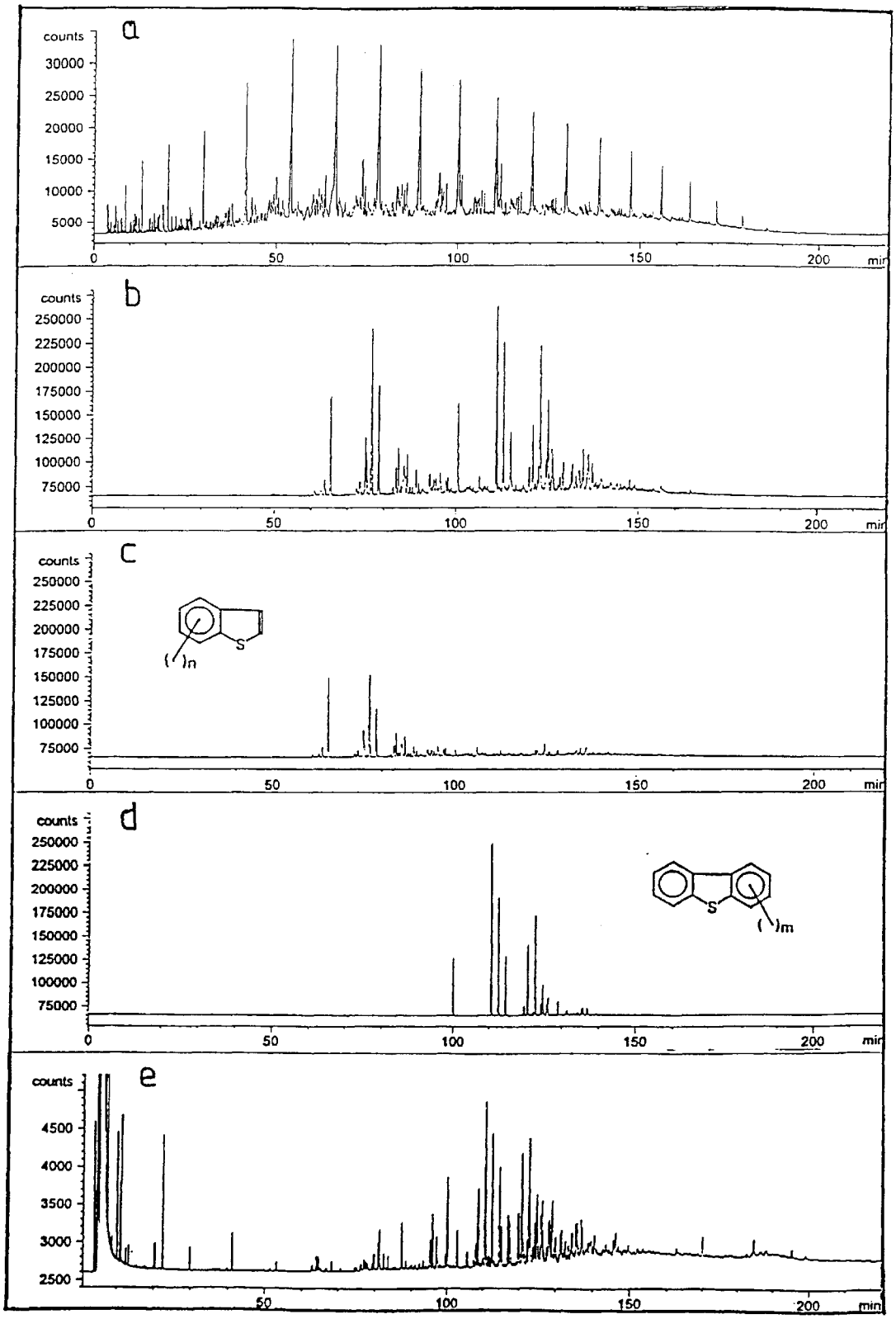

FIG. 4 represents the spectra obtained by gas chromatography (with a flame ionization detector (FID) and a flame photometric detector (FDP [sic]), making possible detection specific to sulfur), showing essentially the presence of derivatives of the dibenzothiophene family, of a gas oil comprising 360 ppm of sulfur. The part a. corresponds to an FPD of a gas oil with a sulfur content of 360 ppm. The part b. corresponds to an FPD of the same gas oil after complexing-filtration with TNF (residual 320 ppm). The part c. corresponds to an FID of the aromatic compounds trapped by the TNF. The part d. corresponds to an FPD of the aromatic compounds trapped by the TNF;

FIG. 5 represents the gas chromatographic analyses (FID and FDP [sic]) of a gas oil comprising 860 ppm of sulfur. The part a. corresponds to an FID of a gas oil with a sulfur content of 860 ppm. The part b. corresponds to an FPD of the same gas oil. The part c. corresponds to an FPD of the gas oil after complexing-filtration with TNF (residual 720 ppm). The part d. corresponds to an FID of the aromatic compounds trapped by the TNF. The part e. corresponds to an FPD of the aromatic compounds trapped by the TNF;

FIG. 6 represents the gas chromatographic analyses (FID and FDP [sic]) of a gas oil comprising 11,300 ppm of sulfur. The part a. corresponds to an FID of a gas oil with a sulfur content of 11,300 ppm. The part b. corresponds to an FPD of the same gas oil. The part c. corresponds to an FPD of the gas oil after complexing-filtration with TNF (residual 9700 ppm). The part d. corresponds to an FPD of the aromatic compounds trapped by the TNF. The part e. corresponds to the FID of the aromatic compounds trapped by the TNF.

In the examples which follow, the benzothiophene compound, 4,6-dimethyldibenzothiophene, was chosen because, as said above, the latter is among the compounds which are the most resistant to known processes for the desulfurization of a mixture of hydrocarbons.

EXAMPLE 1

Determination of the association constants between dichlorodicyanobenzoquinone (DDQ), 4,6-dimethyldibenzothiophene (DMDBT) and a product mimicking the aromatics present in gas oil.

Figure 1:
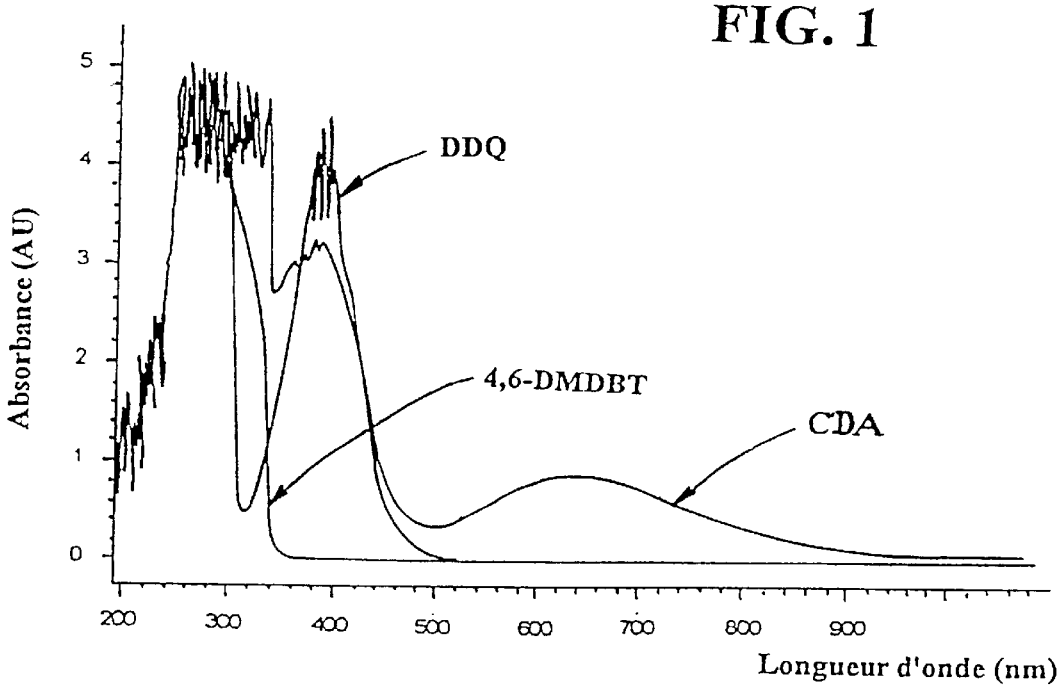
FIG. 1 represents a UV/visible spectrum of a donor-acceptor complex in solution, namely between dichlorodicyanobenzoquinone, as π-acceptor complexing agent, and 4,6-dimethyldibenzothiophene, as benzothiophene compound.

For the purposes of simplicity, dichlorodicyanobenzoquinone (DDQ) was chosen as π-acceptor complexing agent. This commercial compound is known to readily form donor-acceptor complexes (DAC) with electron-rich aromatics. The mixing of solutions of DDQ and of DMDBT in chloroform results in the appearance of an intense blue coloring ($\lambda$max of the charge transfer band=633 nm, see FIG. 1). The association constant was evaluated, at 25° C., at 33 $l.mol^{-1}$, i.e. $\Delta G°$=15 kJ/mol, using the method of Foster, Hammick and Wardley (R. Foster, D. LL. Hammick and A. A. Wardley, J. Am. Chem. Soc., 3817 (1953)).

Figure 2:
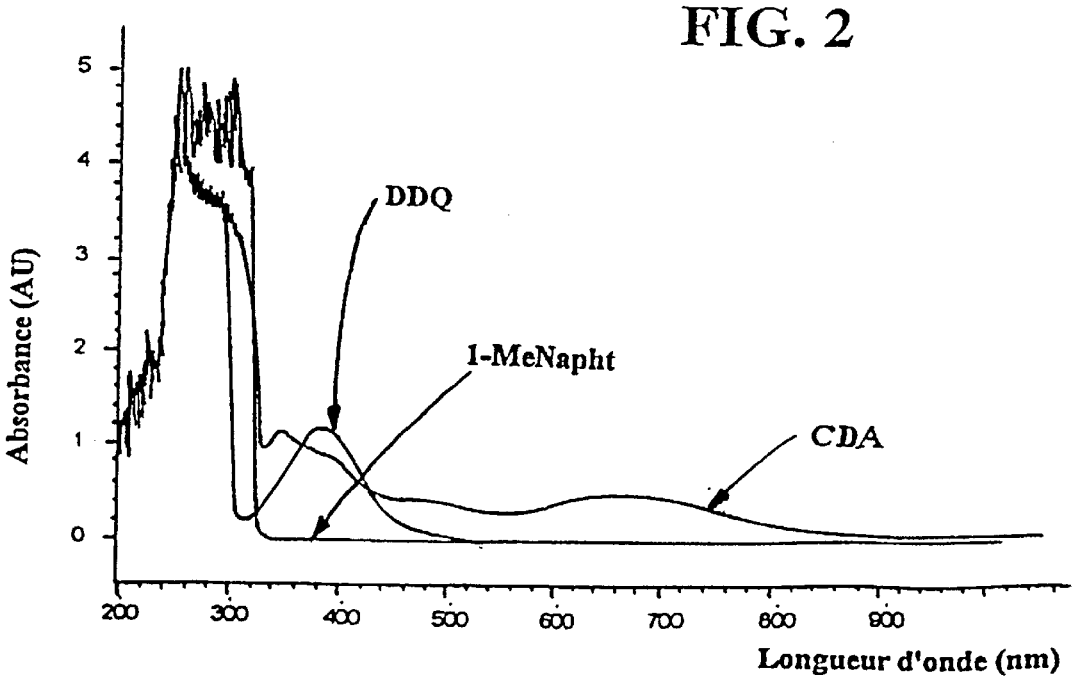
FIG. 2 represents a UV/visible spectrum of another donor-acceptor complex in solution, namely between dichlorodicyanobenzoquinone, as π-acceptor complexing agent, and 1-methylnaphthalene.

1-Methylnaphthalene (MN) was chosen, analogously to that which was presented in the United States patent discussed above, to simulate the condensed aromatic compounds which can compete with DMDBT and its isomers in complexing with DDQ. The association constant was determined under the same conditions as for DMDBT, the $\lambda$max of the band of the donor-acceptor complex (DAC) being 654 nm (green coloring and its $\Delta G°$=7.3 kJ/mol (cf. FIG. 2).

The measurements of the association constants show that DDQ, a $\pi$ acceptor, forms a complex with DMDBT and MN but that the association with DMDBT is twice as strong as that with MN. Although the structure of the $\pi$ acceptor has not be optimized, a significant selectivity is observed.

EXAMPLE 2

Separation of traces of DMDBT from a solution of alkanes.

Figure 3:
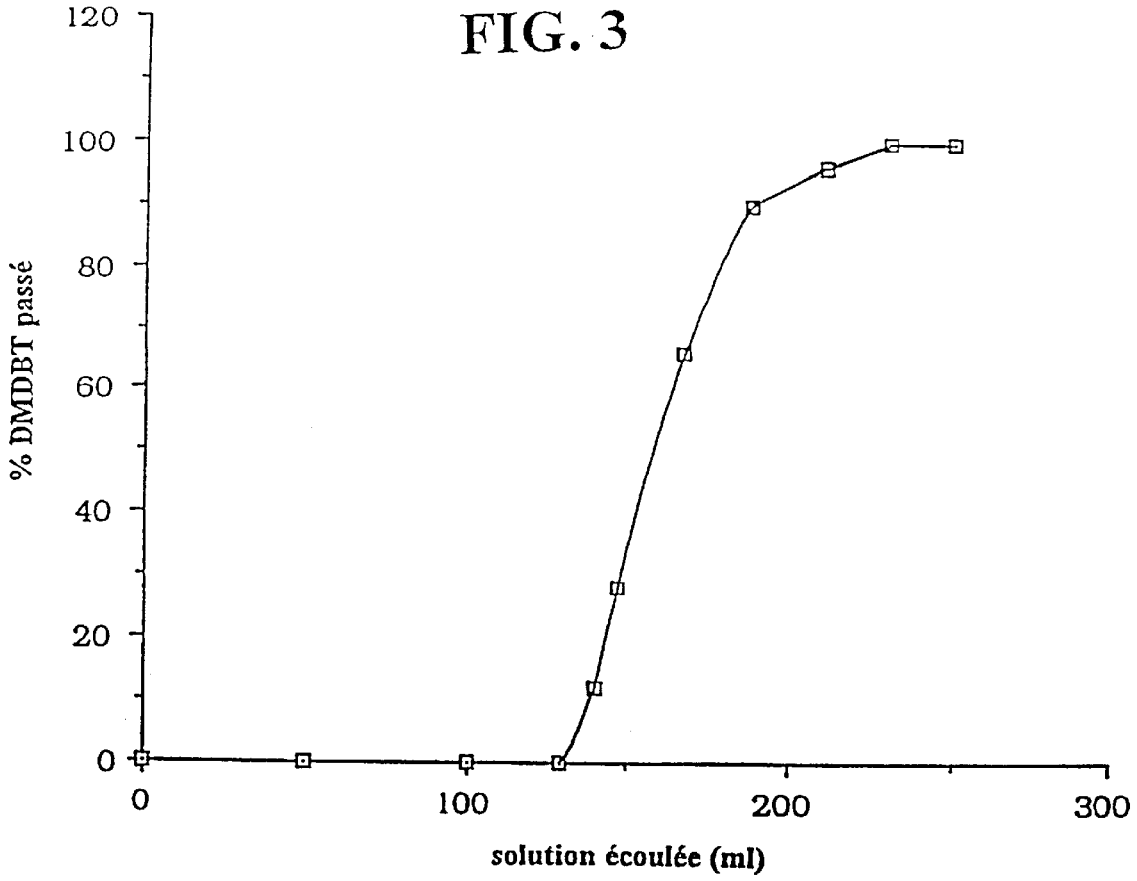
FIG. 3 represents a graph showing the change in the concentration of 4,6-dimethyldibenzothiophene in a solution composed of the latter and of heptane, as a function of the volume of eluent, when the process of the invention is applied to such a solution.

A 2.64 g/l solution of DMDBT (0.06% as sulfur) in heptane was filtered through a column comprising silica charged with 10% of DDQ (560 mg). 7-ml fractions were collected and the appearance of DMDBT was monitored by capillary gas chromatography (GC) by the internal standard method, in the presence of dodecane (nonpolar column, JW DB-5, injector: 300° C., detector: 320° C., oven programming: 60° C. to 300° C. (10° C./min). FIG. 3 shows the change in the concentration of DMDBT as a function of the volume of eluent. On considering the amount of DMDBT attached during the elution, it is noted that more than 90% of the DDQ molecules had formed a complex of 1/1 stoichiometry with the DMDBT present in the heptane.

In order for the selective separation process according to the invention to be advantageous from an economic view point, it is preferable to regenerate the reagent or to recover the $\pi$-acceptor complexing agent. A great many methods, in particular thermal methods, exist for recovering the charge transfer complex. The chemical route was preferably chosen because it is very easy to carry out and it makes it possible to easily evaluate the potential degree of recovery of the reagent.

The DDQ/DMDBT complex was extracted with chloroform and then this solution [lacuna] washed with an aqueous solution of sodium bisulfite (10%) and of sodium carbonate. This solution has the effect of reducing the DDQ to DDHQ (hydroquinone), which makes it possible to extract this hydroquinone in the phenate form. The DDHQ was recovered by neutralization of the aqueous solution and the DMDBT by evaporation of the chloroform solution. In both cases, the regeneration yields are greater than 90%.

Example 2 shows that it is possible to completely separate DMDBT present in a solution of alkanes by simple filtration of the solution of alkanes through silica which supports DDQ. Virtually all the DDQ is used to form a 1/1 complex with the DMDBT, which is thus removed from the mixture of hydrocarbons. The complex can be separated, for example by reduction of the DDQ to DDHQ. The two components can be recovered and separated, and the DDHQ can be recycled to DDQ by oxidation according to known methods.

EXAMPLE 3

This example describes the separation of DMDBT from a solution of alkanes also comprising a product "mimicking" the aromatic derivatives present in gas oil.

100 ml of a solution comprising 0.04% of sulfur in heptane were prepared comprising equimolar amounts of DMDBT (196 mg), of MN (131 mg) and of dodecane (157 mg) as internal standard. An equimolar amount of reagent was added and the mixture was stirred at 20° C. The separation factor measured between the DMDBT and the MN is defined as:

$$\alpha_{DMDBT/MN}=[DMDBT/MN]_{complex}/[DMDBT/MN]_{soln}$$

Other potential acceptor compounds were also tested; the results obtained, with regard to the separation factors and the capacities, are summarized in the following Table 1.

TABLE 1

Values of the capacity and of the separation factor measured between DMDBT and MN as a function of the duration of stirring for various acceptors

| Stirring time (room T) | 4 h 30 | 21 h | 29 h | 45 h | 96 h | Capacity ($g_{DMDBT}/g_{precipitated\ complex}$) |
|---|---|---|---|---|---|---|
| Benzaquinone | — | — | | | | |
| Dinitrofluorenone | 0 | 0 | — | — | 0 | |
| Anthraquinone | 0 | 0.5 | — | — | 2.5 | 50% |
| DDQ | 28 | 42 | 35 | 90 | >1000 | 48% |
| Tetranitrofluorenone | 137 | >1000 | >1000 | >1000 | >1000 | 37% |
| Tetracyanoquinodimethane | 9.5 | — | 132 | 391 | 191 | 51% |

The complex formed between tetranitrofluorenone and DMDBT gives the best results in terms of specificity. The very high (unmeasurable) value of the selectivity is very rapidly achieved, indicating that the MN has remained in solution whereas the DMDBT has been completely complexed by the tetranitrofluorenone. The capacity of these reagents, defined as the percentage by mass of DMDBT in the complex formed, is 37% for tetranitrofluorenone and 51% for tetracyanoquinodimethane.

EXAMPLE 4

Competitive complexing of DMDBT and fluorene in heptane.

Aromatic molecules, such as fluorene, exist in partially desulfurized gas oils. This compound might compete with DMDBT molecules in forming a donor-acceptor complex, as disclosed in U.S. Pat. No. 5,454,933. This test is therefore much more stringent and representative of "real" gas oil. It was carried out under the same conditions as in Example 3 but with one equivalent of fluorene in place of the 1-methylnaphthalene. The results obtained are combined in Table 2 below.

TABLE 2

Competitive complexing of DMDBT and fluorene with TNF

| Stirring time (h) | DMDBT adsorbed (%) | Fluorene adsorbed (%) | Separation factor |
|---|---|---|---|
| 1 | 27.1 | 3.7 | 9 |
| 2.5 | 37.4 | 1.9 | 30 |
| 17.25 | 65.7 | 7.3 | 24 |
| 24 | 78.3 | 13.7 | 19 |
| 40.5 | 87.8 | 10 | 60 |
| 67.25 | 92.6 | 12.9 | 84 |
| 115 | 92.2 | 13.2 | 78 |

The complexing was slower and less specific than between DMDBT and MN but, in this case again, a selectivity coefficient was obtained which is much greater has [sic] those disclosed in the abovementioned United States patent.

EXAMPLE 5

Removal of the DMDBT present in an industrial gas oil.

A gas oil, conventionally desulfurized by heterogeneous catalysis, was diluted in a proportion of 15 ml in 200 ml of heptane. The solution obtained exhibited a sulfur content (measured by X-ray fluorescence) of 214 ppm, approximately half of which was composed of DMDBT and other benzothiophene compounds and the other half of which was composed of nonaromatic or weakly aromatic sulfur-comprising compounds. 328 mg of tetranitrofluorenone were added, which corresponded to one equivalent of tetranitrofluorenone with respect to the amount of DMDBT and other benzothiophene compounds present in this solution. Samples of this suspension were withdrawn and then, after filtration, the sulfur content was quantitatively determined by X-ray fluorescence. The results are given below in Table 3.

TABLE 3

Change in the sulfur content of a gas oil solution diluted [sic] in heptane as a function of the time in contact with tetranitrofluorenone

| Stirring time | Level of sulfur measured (ppm) |
|---|---|
| 24 h | 184 |
| 49 h | 137 |
| 74 h | 119 |
| 146 h | 112 |

The results described in Table 3 show that the combined benzothiophene compounds of DMDBT type are separated from the mixture of hydrocarbons by complexing with tetranitrofluorenone. After filtration, the precipitate was analysed by NMR and IR and was composed of tetranitrofluorenone and DMDBT.

EXAMPLE 6

Separation of DMDBT and other benzothiophene compounds from gas oil without dilution.

For this example, use was made of 100 ml of gas oil comprising 1920 ppm of sulfur, at least 50% of which was in the form of DMDBT and other analogous benzothiophene compounds. 961 mg of tetranitrofluorenone were introduced into this gas oil and various samples were withdrawn after filtration. The sulfur in this gas oil was quantitatively determined by X-ray fluorescence. The results are given below in Table 4.

TABLE 4

Change in the sulfur content during the complexing of uz,5/28 the DMDBT present in industrial gas oil

| Stirring time | Level of sulfur measured (ppm) |
|---|---|
| 92 h | 840 |
| 116 h | 820 |
| 140 h | 320 |

In this example, it is noted that approximately 60% of the sulfur present in the gas oil has been complexed after being in contact for 92 h. This value corresponds substantially to the DMDBT content in the initial gas oil, which shows that the separation process according to the present invention is particularly selective and efficient with regard to DMDBT.

EXAMPLE 7

Selective removal of the compounds of the dibenzothiophene family from a gas oil comprising 360 ppm of sulfur.

50 g of a gas oil comprising 360 ppm of sulfur (measured by X-ray fluorescence), conventionally desulfurized by heterogeneous catalysis, are stirred for 6 days with 220 mg of TNF with magnetic stirring. The number of moles of TNF added is identical to the number of total moles [sic] of sulfur present, the molecular mass of 4,6-dimethyldibenzothiophene (212 g/mol) being regarded as mean representative mass. A brown precipitate is formed, which precipitate is filtered off. The filtrate exhibits, by X-ray fluorescence measurement, a residual sulfur content of 320 ppm. The residue, comprising TNF, and the complexed molecules, are [sic] passed through a silica column (elution with toluene) in order to separate them. It is deduced therefrom that 70% of the TNF introduced has been used in the formation of charge transfer complexes. Gas chromatographic analyses (FID and FPD) are given in FIG. 4.

The differences between the chromatograms a. and b. show that the amount of 4,6-dimethyldibenzothiophene present in this gas oil has greatly decreased. The chromatogram of the complex d. reveals the presence of unsubstituted dibenzothiophene, whereas this compound could not be identified in the chromatogram a. of the gas oil. By comparison of the areas of each peak of the chromatogram c., where all the complexed aromatic compounds (heterocyclic or nonheterocyclic) are listed, and considering that the response factors are similar, it may be concluded that the sulfur-comprising molecules represent approximately 5% by weight of the complexed aromatic compounds.

EXAMPLE 8

Selective removal of the compounds of the dibenzothiophene family from a gas oil comprising 860 ppm of sulfur.

In a way identical to the procedure described in Example 7, 50 g of a gas oil comprising 860 ppm of sulfur are stirred for 6 days with 483 mg of TNF. After filtering off the residue, the filtrate exhibits, by X-ray fluorescence measurement, a residual sulfur content of 720 ppm. After decomplexing the aromatic molecules, it is deduced therefrom that 50% of the TNF introduced has been used in the formation of donor-acceptor complexes. Gas chromatographic analyses are given [lacuna] FIG. 5.

This gas oil predominantly comprises mono- or polyalkylated dibenzothiophene derivatives (chromatogram b.). An exact analysis of the gas oil after filtration (chromatogram c.) clearly shows that the procedure is specific for the complexing of alkyldibenzothiophenes. A marked decrease in concentrations of 4-MDBT, 4,6-DMDBT and 2,8-DMDBT is observed between the chromatograms b. and c. However, two families of products are found in the elution range for trisubstituted dibenzothiophenes: some of them form donor-acceptor complexes with TNF (*, FIG. 5), whereas others (#, FIG. 5) are not removed. The first compounds (*) are trialkylated dibenzothiphene [sic] derivatives. As regards the complexed molecules (chromatogram d. and e.), the sulfur-comprising aromatics represent 25% by weight of the total mass of the compounds retained. A mass spectrometric analysis shows that the structure of these aromatics which compete in the complexing with TNF are [sic] fluorene, anthracene, phenanthrene and the corresponding alkylated derivatives. The molecular mass of the trapped aromatic compounds varies between 166 and 220 mol/g.

EXAMPLE 9

Selective removal of the compounds of the dibenzothiophene family from a gas oil comprising 11,300 ppm of sulfur which has not been subjected to a prior stage of conventional catalytic hydrodesulfurization In a way identical to the procedure described in Example 7, 50 g of a gas oil comprising 11,300 ppm of sulfur are stirred for 6 days with 6.4 g of TNF. After filtering off the residue, the filtrate exhibits, by X-ray fluorescence measurement, a residual sulfur content of 9700 ppm. After decomplexing the aromatic molecules, it is deduced therefrom that 20% of the TNF introduced has been used in the formation of donor-acceptor complexes. Gas chromatographic analyses are given in FIG. 6.

This gas oil comprises derivatives of the benzothiophene family and of the dibenzothiophene family (chromatogram b.). The gas oil obtained after complexing with TNF and filtering (chromatogram s [sic]) only comprises benzothiophenes: all the peaks corresponding to the dibenzothiophene derivatives have disappeared. On the other hand, all the sulfur-comprising aromatics which have been trapped are dibenzothiophene derivatives (chromatogram d.). The complexing-filtration procedure described is therefore, in this case, completely selective for dibenzothiophene derivatives with respect to benzothiophene derivatives. From the chromatogram e., it is calculated that the sulfur-comprising derivatives represent 55% by weight of the total mass of the complexed aromatics.

What is claimed is:

1. A process for the separation of at least one dibenzothiophene compound from a mixture of hydrocarbons, wherein said mixture or a fraction obtained from the mixture is brought into contact with a reagent comprising a π-acceptor complexing agent, in order to obtain a donor-acceptor complex between the acceptor complexing agent and said dibenzothiophene compound;

said complex being separated from said mixture or from said fraction, in order to obtain a fraction impoverished in or purified from said dibenzothiophene compound.

2. The process according to claim 1, wherein the process is carried out in a homogenous phase.

3. The process according to claim 1, wherein the process is carried out in a heterogeneous phase.

4. The process according to claim 1, wherein the fraction impoverished in dibenzothiphene compound is subjected to a catalytic hydrodesulfurization.

5. The process according to claim 1, further including:

regenerating the reagent by separating the complex into dibenzothiophene compound and complexing agent.

6. The process according to claim 5, wherein the separation of the complex is carried out chemically.

7. The process according to claim 1, wherein the π-acceptor complexing agent comprises an aromatic compound substituted by at least one electron-withdrawing group selected from the group consisting of sulfo, nitro, fluoro, trifluoromethyl, cyano, carbonyl, carboxyl, amido, and carbamido groups.

8. The process according to claim 1, wherein the π-acceptor complexing agent comprises a quinone substituted by at least one electron-withdrawing group.

9. The process according to claim 1, wherein the π-acceptor complexing agent is selected from the group consisting of substituted or unsubstituted quinones and substituted or unsubstituted fluorenones.

10. The process according to claim 1, wherein the π-acceptor complexing agent is selected from the group consisting of dichlorodicyanobenzoquinone, anthraquinone, benzoquinone, tetracyanoquinodimethane, tetranitrofluorenone or dinitrofluorenone.

11. The process according to claim 6, wherein the reagent is regenerated:

by reducing the complex separated from the mixture, in order to form a salt of the π-acceptor agent; and by reoxidizing the salt, in order to regenerate the π-acceptor complexing agent.

12. The process according to claim 1, wherein the reagent comprises a support, to which the π-acceptor complexing agent is attached, said support being in the divided or undivided form and selected from the group consisting of inorganic oxides, such as alumina and silica, activated charcoal, ion-exchange resins and zeolites.

13. The process according to claim 1, wherein the reagent is composed essentially of the π-acceptor complexing agent.

14. The process according to claim 1, wherein the reagent is composed essentially of a polymer of the π-acceptor complexing agent.

15. The process according to claim 1, wherein the mixture of hydrocarbons is brought into contact with the reagent for a period of between approximately 10 minutes and 150 hours.

16. The process according to claim 1, wherein the mixture of hydrocarbons is brought into contact with the reagent at a temperature of between 10° C. and 60° C.

17. The process according to claim 1, wherein the process is carried out continuously.

18. The process according to claim 1, wherein the mixture of hydrocarbons is brought into contact contercurrentwise with the reagent, in a column, at a flow rate of between 0.5 ml/min to 50 ml/min per $cm^3$ of column volume.

19. The process according to claim 1, wherein the mixture of hydrocarbons is brought into contact with the reagent with stirring.

20. The process according to claim 1, wherein the mixture of hydrocarbond is a gas oil.

21. The process according to claim 1, wherein the mixture of hydrocarbons is brought into contact with the reagent for a period of between approximately 2.5 hours and 115 hours.

* * * * *

UNITED STATES PATENT AND TRADEMARK OFFICE

CERTIFICATE OF CORRECTION

PATENT NO. : 6,441,264 B1
DATED : August 27, 2002
INVENTOR(S) : Marc Lemaire et al.

It is certified that error appears in the above-identified patent and that said Letters Patent is hereby corrected as shown below:

Title page,
Item [75], Inventors, after "Lamure," delete "Lyons" and insert -- Lyon --.

Column 1,
Line 65, after "[DBT/MN]" delete "soln" and insert -- sol --.

Column 8,
Table 4, line 6, after "of" delete "uz,5/28".

Column 10,
Line 54, after "contact" delete "contercurrentwize" and insert -- countercurrentwize --.

Signed and Sealed this

Ninth Day of May, 2006

JON W. DUDAS
*Director of the United States Patent and Trademark Office*